US006956218B1

(12) United States Patent
Douglas

(10) Patent No.: US 6,956,218 B1
(45) Date of Patent: Oct. 18, 2005

(54) COMPACTION MANAGED MIRROR BEND ACHROMAT

(75) Inventor: David Douglas, Yorktown, VA (US)

(73) Assignee: Southeastern Univ. Research Assn., Inc., Newport News, VA (US)

( * ) Notice: Subject to any disclaimer, the term of this patent is extended or adjusted under 35 U.S.C. 154(b) by 0 days.

(21) Appl. No.: 10/814,919

(22) Filed: Mar. 31, 2004

(51) Int. Cl.[7] ..... H01J 3/12
(52) U.S. Cl. ..... 250/396 ML
(58) Field of Search ..... 250/396 ML, 296 R; 372/2

(56) References Cited

U.S. PATENT DOCUMENTS 3,202,817 A * 8/1965 Belbeoch ..... 250/396 ML
6,885,008 B1 * 4/2005 Douglas et al. ..... 250/396 ML

OTHER PUBLICATIONS

David Douglas, "A Compact Mirror-Bend-Achromat-Based Energy Recovery Transport System for an FEL Driver", Jul. 24, 2002, pp. 1-26, Jefferson Lab Technical Paper TN-02-026, published by Jefferson Lab in the USA.

* cited by examiner

*Primary Examiner*—Jack I. Berman

(57) ABSTRACT

A method for controlling the momentum compaction in a beam of charged particles. The method includes a compaction-managed mirror bend achromat (CMMBA) that provides a beamline design that retains the large momentum acceptance of a conventional mirror bend achromat. The CMMBA also provides the ability to tailor the system momentum compaction spectrum as desired for specific applications. The CMMBA enables magnetostatic management of the longitudinal phase space in Energy Recovery Linacs (ERLs) thereby alleviating the need for harmonic linearization of the RF waveform.

7 Claims, 6 Drawing Sheets

Figure 3: $M_{56}$ = -0.2 m (appropriate for acceleration at 750 MHz –20° off-crest)
Half-achromat; beams in steps of momentum equal to 10% of full momentum: 0.1 x full, 0.2 x full, 0.3 x full, …, full
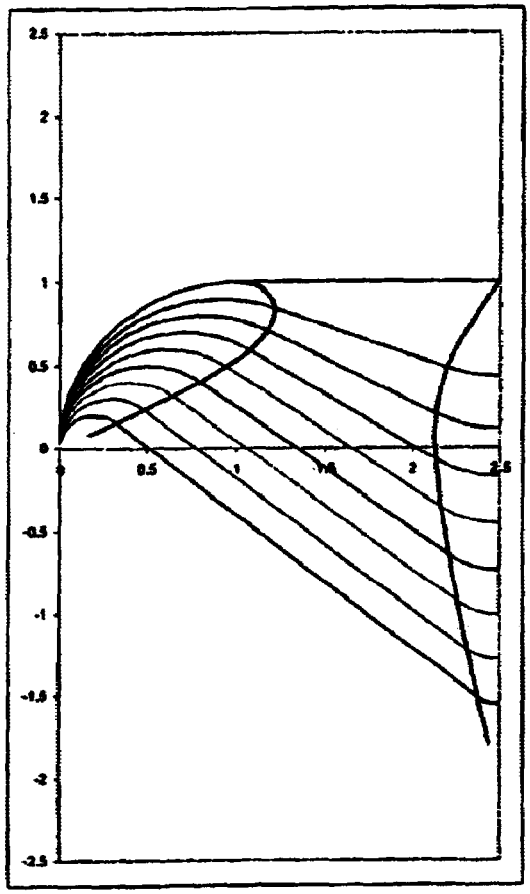
Path length vs. radius (~momentum)
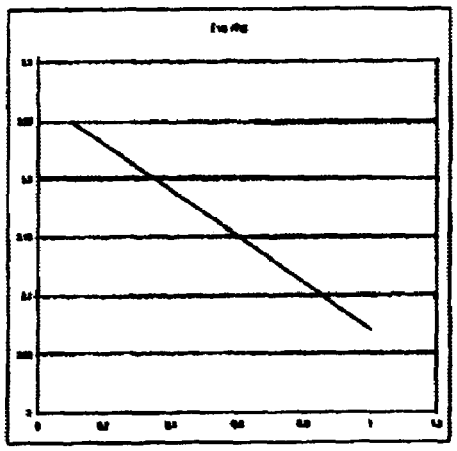

Figure 4: $M_{56} = 0$ (example of strictly isochronous transport)
Half-achromat; beams again in 10% in momentum
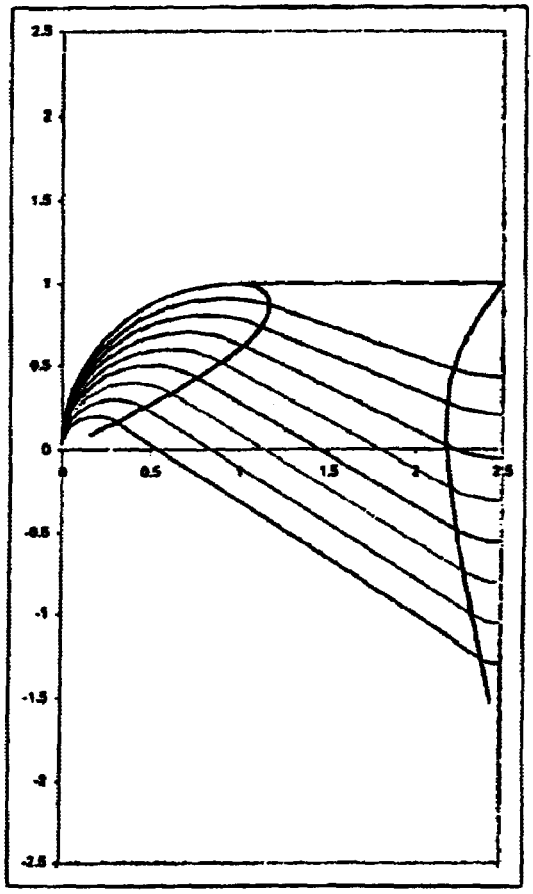
Path length vs. radius (~momentum)
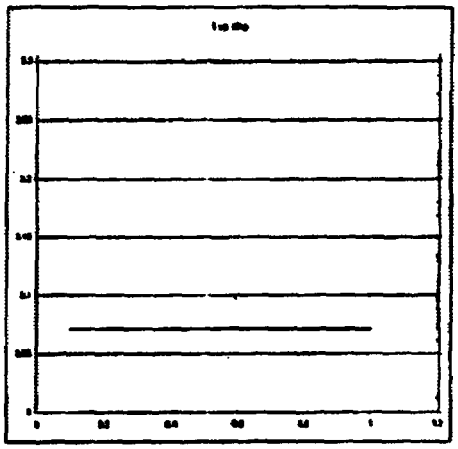

Figure 5: $M_{56}$ = 0.2 m (appropriate for energy recovery at 750 MHz when accelerating – 20° off-crest)
Half-achromat; beams again in 10% in momentum
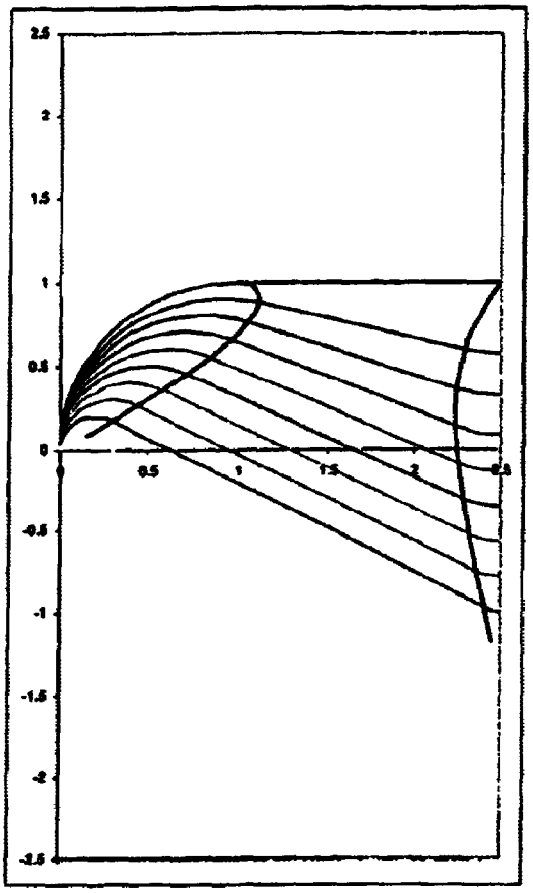
Path length vs. radius (~momentum)
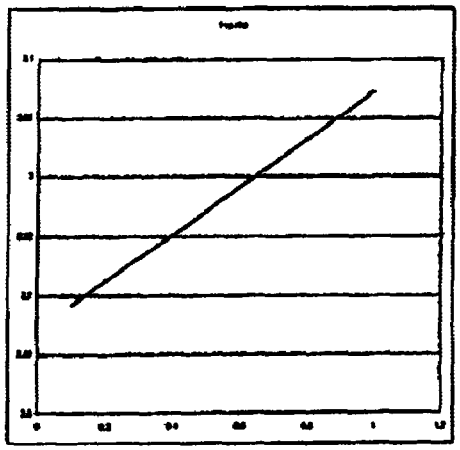

Figure 6: Conceptual use of CMMBA in an FEL driver ERL
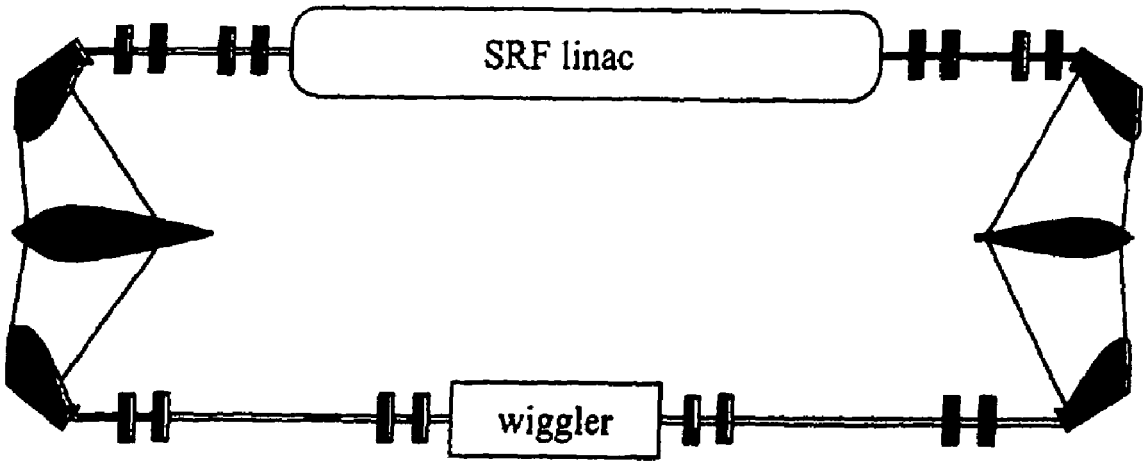

COMPACTION MANAGED MIRROR BEND ACHROMAT

The United States of America may have certain rights to this invention under Management and Operating contract No. DE-AC05-84ER 40150 from the Department of Energy.

FIELD OF THE INVENTION

The present invention relates to charged particle accelerators and particularly to a method for controlling the momentum compaction in a beam of charged particles.

BACKGROUND OF THE INVENTION

The use of mirror-bend achromats (MBAs) has been proposed in energy recover linear accelerators (ERLs) for manipulating the path of charged particles. The MBA is typically a linear, large acceptance beam deflection system. The effectiveness of the MBA is, however, limited by the restricted range of momentum compactions available in the conventional mirror-bend design.

In a conventional mirror-bend design, the compactions are completely constrained by the gross MBA geometry, including the bend radius and angle, and are inherently positive and linear. As a result, the conventional MBA necessitates the use of additional bending modules, such as chicanes, when correction of aberrations or negative compactions is necessary.

What is needed for compact ERLs and similar particle accelerators is a design methodology freeing the MBA from both the close coupling of compaction to bend geometry and the inherently positive compaction.

SUMMARY OF THE INVENTION

The present invention is a method for controlling the momentum compaction in a beam of charged particles. The method includes a compaction-managed mirror bend achromat (CMMBA) that provides a beamline design that retains the large momentum acceptance of a conventional mirror bend achromat. The CMMBA also provides the ability to tailor the system momentum compaction spectrum as desired for specific applications. The CMMBA enables magnetostatic management of the longitudinal phase space in Energy Recovery Linacs (ERLs) thereby alleviating the need for harmonic linearization of the RF waveform.

DESCRIPTION OF THE DRAWINGS

FIG. 3 shows a graph depicting pole face contours and orbit geometries for an example CMMBA with momentum compaction spectrum ($M_{56}$) of −0.2 m and a graph of the resultant path length versus radius.

FIG. 4 shows a graph depicting pole face contours and orbit geometries for an example CMMBA with momentum compaction spectrum ($M_{56}$) of 0 m and a graph of the resultant path length versus radius.

FIG. 5 shows a graph depicting pole face contours and orbit geometries for an example CMMBA with momentum compaction spectrum ($M_{56}$) of 0.2 m and a graph of the resultant path length versus radius.

FIG. 6 shows a conceptual implementation of the CMMBAs of FIGS. 3 and 5 in a compact free electron laser (FEL) driver.

REFERENCE NUMERALS USED IN THE SPECIFICATION AND DRAWINGS

10—conventional mirror-bend achromat (Prior Art)
12—first dipole
14—second dipole
16—system symmetry line of MBA
20—first half of a 180° compaction managed mirror bend achromat
22—entrance pole-face of MBA
24—incoming beam
26—exit pole-face of MBA
28—pole-face of extended field region of the CMMBA
30—pole-face of the central reverse bend region of the CMMBA
32—system symmetry line of 180° CMMBA

DETAILED DESCRIPTION

Figure 1:
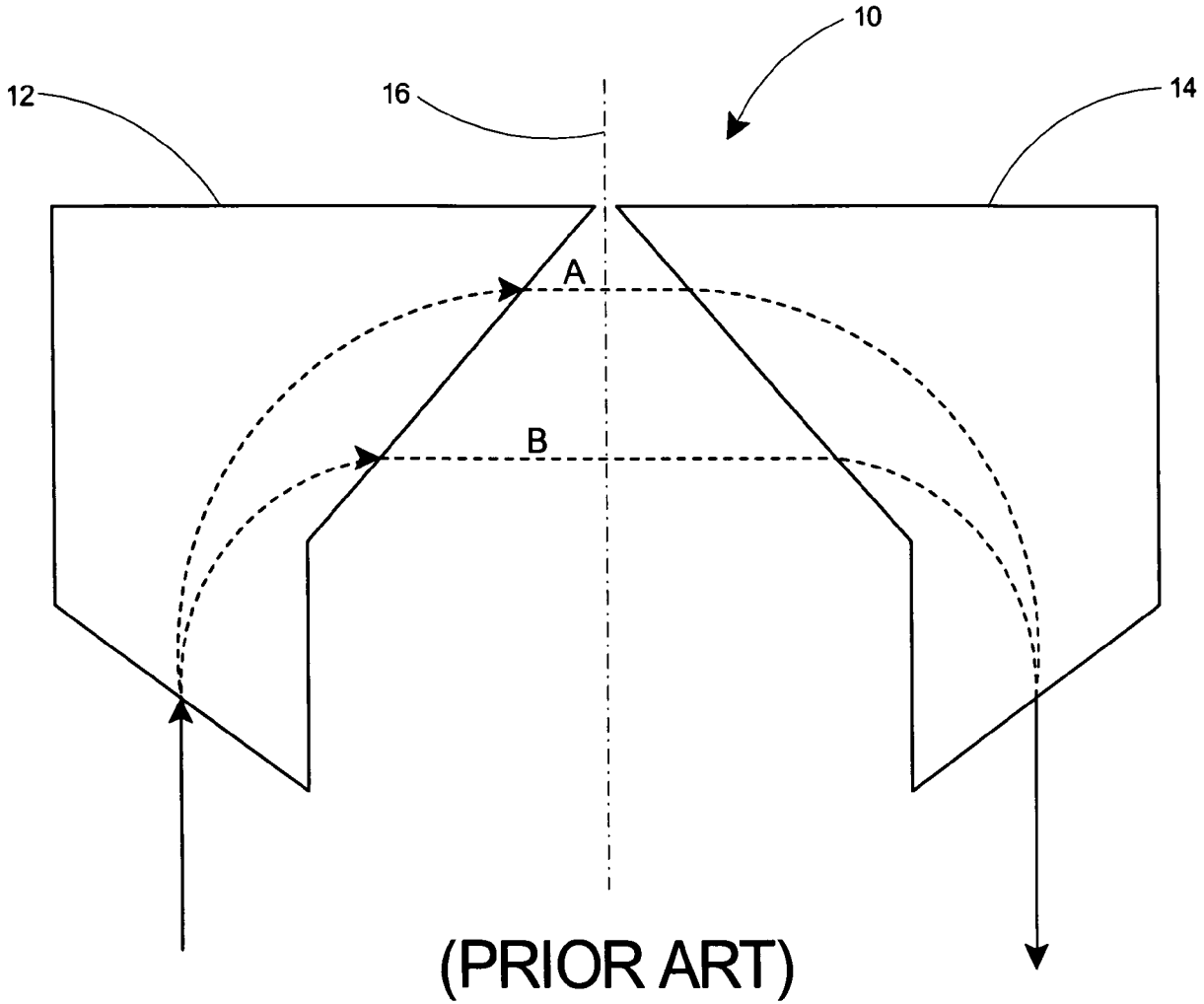
(PRIOR ART) Fig. 1
FIG. 1 is a conceptual schematic view of a conventional MBA.

Description of the Present State of the Art:

With reference to FIG. 1, a conceptual view is shown of a prior art mirror-bend achromat 10. The 180° mirror-bend achromat 10 includes a pair of 90° bends. The arc geometry in FIG. 1 includes two 90° dipoles 12 and 14 symmetrically positioned around the system symmetry line 16. Two beam components, each at a different energy level, are shown having paths A and B. The lower energy component, following path B, invariably travels a shorter distance than any having a higher energy component, such as that following path A. As a result of the lower energy component following the shorter path, the compaction will inherently be positive.

Though possessed of very large momentum acceptance, mirror-bend achromats provide little design and operational flexibility in betatron and dispersion management. They are completely achromatic—the exit orbit is, by geometric construction, momentum independent—and linearly compactional—the path length depends only linearly on momentum offset. The simple system configuration provides only a limited number of parameters for optimization. The dispersion at the symmetry point and the momentum compaction are defined by the bend angle and bend radius. In this geometry, the "interior" pole faces must be rotated by 45° (in the horizontally focusing direction) to generate the mirror geometry. The bend radius, the entry pole face rotation of the first dipole, the exit pole face rotation of the second dipole, and the bend-to-bend separation are thus the only parameters available for optimization. The lower limit of first of these is typically set by both the dipole field required to bend a beam at a particular energy and the fact that smaller bend radii correspond to stronger focusing and thus aggravate the betatron matching problem imposed by the large pole face angles used in the mirror bend configuration. A lower limit on momentum compaction is thereby specified.

Various applications have been proposed for ERLs, and each of these applications typically requires its own unique momentum compaction spectrum. Therefore, it is desirable to develop a design methodology freeing the conventional MBA from both the close coupling of compaction to bend geometry and the inherently positive compaction. What is needed is a mechanism to lengthen the lower energy orbits in a conventional mirror-bend achromat, such as path B in FIG. 1, in a controlled fashion to as to match its path length to the length of the higher energy component, such as A, while holding the beamline footprint fixed.

Figure 2:
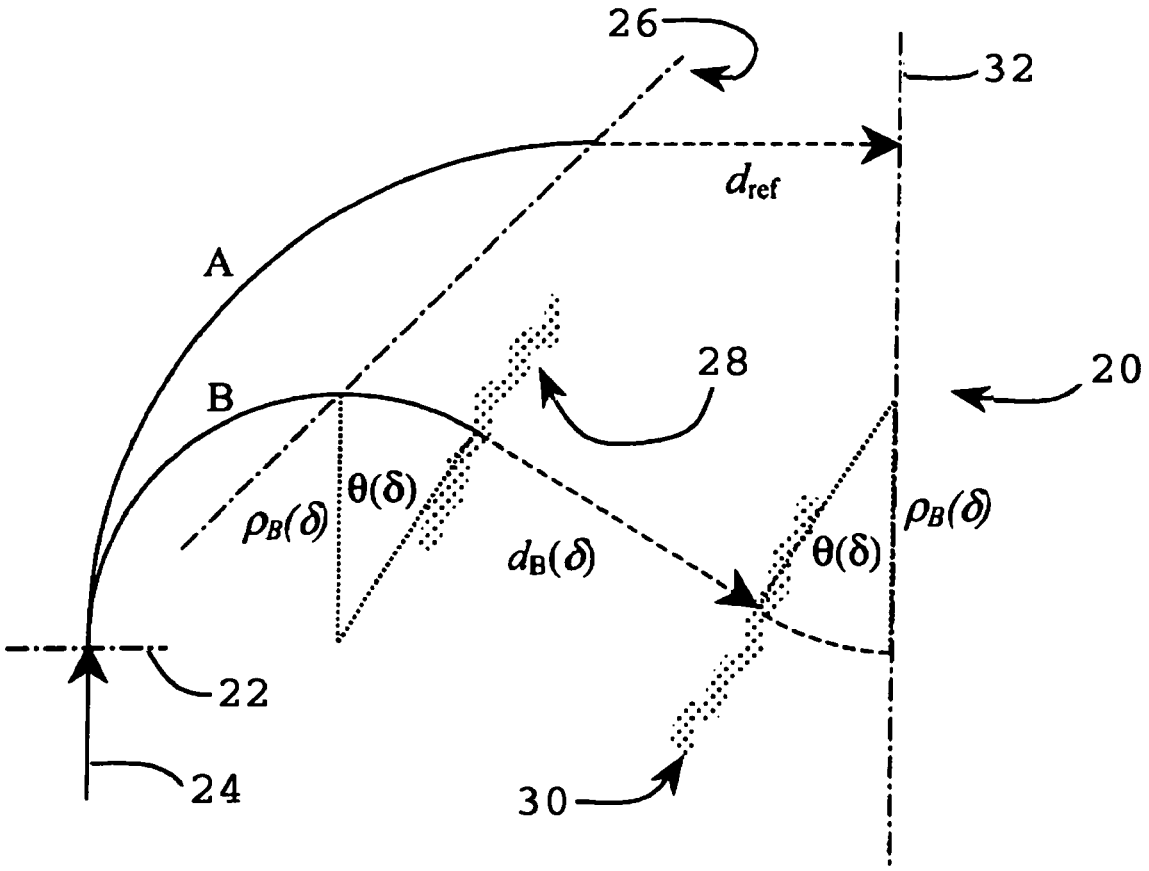
FIG. 2 is a conceptual schematic view of the first half of a 180° Compaction Managed Mirror-Bend Achromat according to the present invention.

Description of the Present Invention:

Referring to FIG. 2, a conceptual view is shown of the first half of a 180° compaction-managed mirror bend achromat 20 according to the present invention. To tailor the system momentum compaction for a specific ERL application, a mechanism is developed to lengthen the lower energy orbits in a controlled fashion so as to match their length to that of the higher energy component. The particular case illustrated in FIG. 2 is that of a 180 degree CMMBA, of which the first half is shown. The left side portion of FIG. 1 includes a mirror bend achromat in which an incoming beam 24 enters an entrance pole-face 22 of the MBA and then exits at an exit pole-face 26.

A high momentum reference orbit A is selected to set the overall geometry of the CMMBA. The high momentum reference orbit selected thereby sets the overall geometry of the CMMBA by defining the maximum radius of interest $\rho_{ref}$ and the drift length $d_{ref}$ from bend magnet to beam centerline. The trajectory or path length B of the lower energy component will then lie on a smaller radius $\rho_B(\delta)=\rho_{ref}\delta$, where $\delta$ is the fractional momentum of the beam on orbit B relative to that on orbit A ($\delta=\rho_B/\rho_A$), rather than the usual perturbative momentum offset $(\rho_B-\rho_A)/\rho_A$. A compaction-managed mirror bend achromat is created by extending the active magnetic region of the exterior dipole and introducing a central reverse bending region. The pole-face 28 of the extended field region and the pole-face 30 of the central reverse-bend region of the CMMBA are depicted in FIG. 2. This geometry imposes a chicane on the selected lower momentum component B. The additional bend angle $\theta(\delta)$ so introduced lengthens orbit B. Proper selection of this bend angle $\theta(\delta)$ and of the length of the adjacent drift $d_B(\delta)$ enables the length of the low momentum orbit B to match the length of the high momentum orbit A while holding the beamline footprint, including the beamline width and radius, fixed to that defined by the reference orbit. The use of the central bending region insures that the orbit B of the lower momentum component resolves to the correct angle, which in the case of FIG. 2 is 90 degrees, and that the complete CMMBA system is dispersion-suppressed to all orders. To complete the 180° compaction-managed mirror bend achromat 20, second half 90° bend region (not shown) would be added at the line of symmetry 32 depicted in FIG. 2.

The beamline geometry and compaction properties are described by the following equations:

1) Path length: $L=\pi/2\ \rho_{ref}+d_{ref}$ or $L=\pi/2\ \rho_B(\delta)+2\theta(\delta)+d_B(\delta)+F(\delta)$ 2) Beamline "radius": $R=\rho_{ref}+d_{ref}$ or $R=\rho_B(\delta)+2\rho_B(\delta)\sin\theta(\delta)+d_B(\delta)\cos\theta(\delta)$ In the previous equations $F(\delta)$ is a compaction function characterizing the desired dependence of orbit length on momentum and can be related to the usual compaction spectrum $M_{56}$, $T_{566}$, $W_{5666}$, . . . etc. By solving these two equations for the two unknowns, $\theta(\delta)$ and $d_B(\delta)$, at a variety of momenta $\delta$, one can easily specify the location of the pole faces of the bending regions. Assuming an origin at the entry point 22 of the first dipole, the location of the trajectory B (at momentum $\delta$) at the exit pole of the exterior dipole and the entry to the reverse bend are as follows:

3) Exit pole of first dipole:

$$x(\delta)=\rho_B(\delta)\ (1+\sin\theta(\delta))$$

$$y(\delta)=\rho_B(\delta)\cos\theta(\delta)$$

4) Entrance to reverse bend:

$$x(\delta)=\rho_B(\delta)\ (1+\sin\theta(\delta))+d_B(\delta)\cos\theta(\delta)$$

$$y(\delta)=\rho_B(\delta)\ \cos\theta(\delta)-d_B(\delta)\sin\theta(\delta)$$

EXAMPLES

With reference to FIGS. 3–5, pole face contours and orbit geometries are shown for three example CMMBAs. These example CMMBAs were evaluated in each case by solving the above equations for $\theta(\delta)$ and $d_B(\delta)$ at ten momenta ranging from $\delta=1$, where by definition $\theta(\delta=1)=0$ and $d_B(\delta=1)=d_{ref}$, to $\delta=0.1$ in steps of $\Delta\delta=0.1$. A compaction function $F(\delta)=M_{56}(1-\delta)$ was used to illustrate how a specific compaction spectrum may be imposed on the CMMBA. In this particular case, where the selected compaction spectrum is $M_{56}$ and all nonlinear compactions are zero, an FEL driver ERL with 750 MHz RF accelerating −20° off-crest and using third harmonic RF linearization for bunch length and energy compression.

Referring to FIG. 6, a conceptual schematic is shown of the FIG. 3 and FIG. 5 arcs in compact FEL driver of the type discussed in the technical paper by D. Douglas entitled "A Compact Mirror-Bend-Achromat-Based Energy Recovery Transport System for an FEL Driver", Jefferson Lab Technical Paper TN-02-026, Jul. 24, 2002, which is herein incorporated by reference in its entirety.

The method of the present invention is not constrained to MBAs with 180° total angle, but can be extended to other arbitrary overall bend angles and compaction function $F(\delta)$. It therefore provides a basis for a variety of applications requiring large acceptance and longitudinal phase space management. In particular, the ability to set the entire compaction spectrum at design time can be used in the design of compact FEL driver ERLs using only a single RF frequency. Harmonic linearization is therefore not needed; proper selection of T566 and higher order compaction components will allow magnetostatically-based management of the system energy compression.

As the invention has been described, it will be apparent to those skilled in the art that the same may be varied in many ways without departing from the spirit and scope of the invention. Any and all such modifications are intended to be included within the scope of the appended claims.

What is claimed is:

1. A method for controlling the momentum compaction in a beam of charged particles, comprising the steps of:

providing a beamline, said beamline including a centerline and a radius;

providing a compaction-managed mirror bend achromat including a mirror bend achromat having an exterior dipole, a first bend magnet, and a second bend magnet;

selecting a high momentum reference orbit to set the overall geometry of said compaction-managed mirror bend achromat, said geometry including a maximum radius of interest and a drift length from said first bend magnet to said beamline centerline;

providing an extended active magnetic region at said exterior dipole; and introducing a central reverse bending region at the center of said compaction-managed mirror bend achromat.

2. The method of claim 1 wherein said extended active magnetic region and said central reverse bending region impose a chicane on said low momentum component, said chicane including an additional bend angle and an adjacent drift.

3. The method of claim 2 wherein said additional bend angle of said chicane lengthens the orbit of said low momentum component.

4. The method of claim 3 wherein proper selection of said additional bend angle and the length of said adjacent drift allows the length of the low momentum orbit to be matched to the length said high momentum reference orbit.

5. The method of claim 4 wherein said central reverse bending region enables said low momentum orbit to match the angle of said high momentum reference orbit.

6. The method of claim 5 wherein said beam is dispersion-suppressed to all orders.

7. The method of claim 6 wherein said beamline radius is fixed to that defined by said high momentum reference orbit.

* * * * *